United States Patent [19]

Leader

[11] 4,369,711

[45] Jan. 25, 1983

[54] BAG FOR EXPLOSIVES WITH LOWER REINFORCING SLEEVES

[76] Inventor: Harold Leader, Box 400, Industrial Park, Helena, Ala. 35080

[21] Appl. No.: 209,985

[22] Filed: Nov. 24, 1980

[51] Int. Cl.[3] ..... F42B 3/00

[52] U.S. Cl. ..... 102/324; 102/313; 102/323; 102/331; 86/20 C

[58] Field of Search ..... 102/323, 324, 331, 313; 86/20 C, 20 V

[56] References Cited

U.S. PATENT DOCUMENTS

| | | | |
|---|---|---|---|
| 2,764,939 | 10/1956 | Phemister | 102/324 |
| 2,969,101 | 1/1961 | White | 102/324 X |
| 3,122,096 | 2/1964 | Wick | 102/323 |
| 3,696,703 | 10/1972 | Fox | 102/324 X |
| 3,837,279 | 9/1974 | Cooke, Jr. | 102/324 X |
| 3,881,417 | 5/1975 | Mesia | 102/331 |
| 4,052,939 | 10/1977 | Simmons et al. | 102/323 |
| 4,182,242 | 1/1980 | Mesia | 102/331 |
| 4,205,611 | 6/1980 | Slawinski | 102/324 |
| 4,250,811 | 2/1981 | Mackey | 102/331 |
| 4,282,812 | 8/1981 | Forgey et al. | 102/324 X |

FOREIGN PATENT DOCUMENTS

| | | | |
|---|---|---|---|
| 562263 | 8/1958 | Canada | 102/331 |

*Primary Examiner*—Peter A. Nelson

*Attorney, Agent, or Firm*—Sherman Levy

[57] ABSTRACT

A bag for explosives is provided that includes an inner liner of plastic material that has a quantity of granular explosive material therein, and wherein a woven outer member has the liner arranged therein, girdle sleeve portions on the lower end of the bag, and wherein the upper and lower end(s) of the bag are closed.

2 Claims, 7 Drawing Figures

11
13
14
15
16
17
18

BAG FOR EXPLOSIVES WITH LOWER REINFORCING SLEEVES

FIELD OF THE INVENTION

The present invention relates to bags for explosives which are adapted to be used for mining operations or other purposes, and wherein the explosive bags can be dropped down holes, or used in quarry operations or the like, the explosive bag including an inner liner and an outer woven member, and wherein sleeve or girdle portions are arranged on the lower end portion of the bag.

DESCRIPTION OF THE PRIOR ART

Previously, various types of explosive bags have been provided as, for example, as shown in prior U.S. Pat. Nos. 1,824,141, 1,853,921, 2,764,939, 2,911,910, 2,969,101, and 3,113,518. However, neither these prior patents nor any others known to applicant achieve or accomplish the advantages provided by the present invention.

BACKGROUND AND SUMMARY OF THE INVENTION

In accordance with the present invention there is provided a bag for explosives that includes an inner plastic liner, an outer woven member surrounding the liner, and wherein the bag has a suitable quantity of a desired type of granular explosive material. Sleeve-like members or girdle portions are arranged on the lower outer end of the bag, and wherein the bottom portion of the bag is sealed, and wherein the top portion is adapted to be closed after the bag is filled whereby a plurality of the bags can be dropped down a hole to selectively set off the explosion in the desired manner for the desired purpose.

An object of the present invention is to provide a bag for explosives that is constructed so that the bag will not burst until the exact time when it is desired to have the explosive(s) detonated.

A further object of the present invention is to provide a bag for explosives that will selectively rupture at the desired time and point of impact so that the explosive force will take place in a safe and highly efficient manner.

A still further object of the present invention is to provide bags for explosives that are ruggedly constructed and efficient to use and which are relatively simply and inexpensive to manufacture and merchandise.

These and other objects of the invention will be apparent to those skilled in the art in which this invention pertains, and considering the following detailed description and the drawings.

DESCRIPTION OF THE PREFERRED EMBODIMENT

Figure 6:
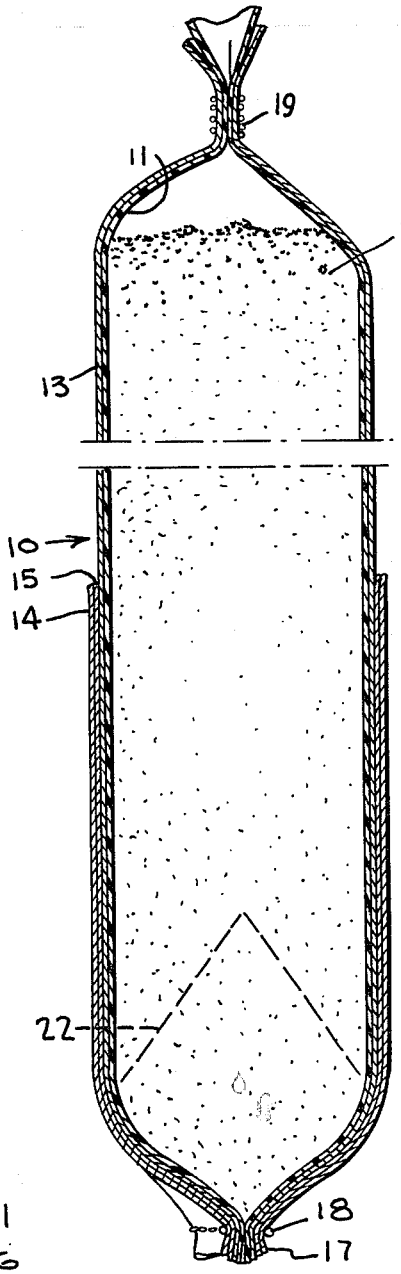
FIG. 6 is an enlarged section view taken on Line 6—6 of FIG. 5.

Referring in detail to the drawings, the numeral 10 indicates the bag for explosives of the present invention which comprises an inner liner 11 made of plastic material, and a suitable quantity of a desired type of granular explosive material 12 is arranged within the bag 10 as shown in FIG. 6 for example.

The numeral 13, indicates an outer woven member which has the liner 11 arranged therein, and the outer woven support member 13 can also be made of woven plastic material and the like. Arranged on the lower portion of the bag 10, are sleeves 14 and 15 which define or provide girdles, and sleeves 14 and 15 may be arranged on approximately the lower one-third of the bag.

Figures 1, 2, 3, 4:
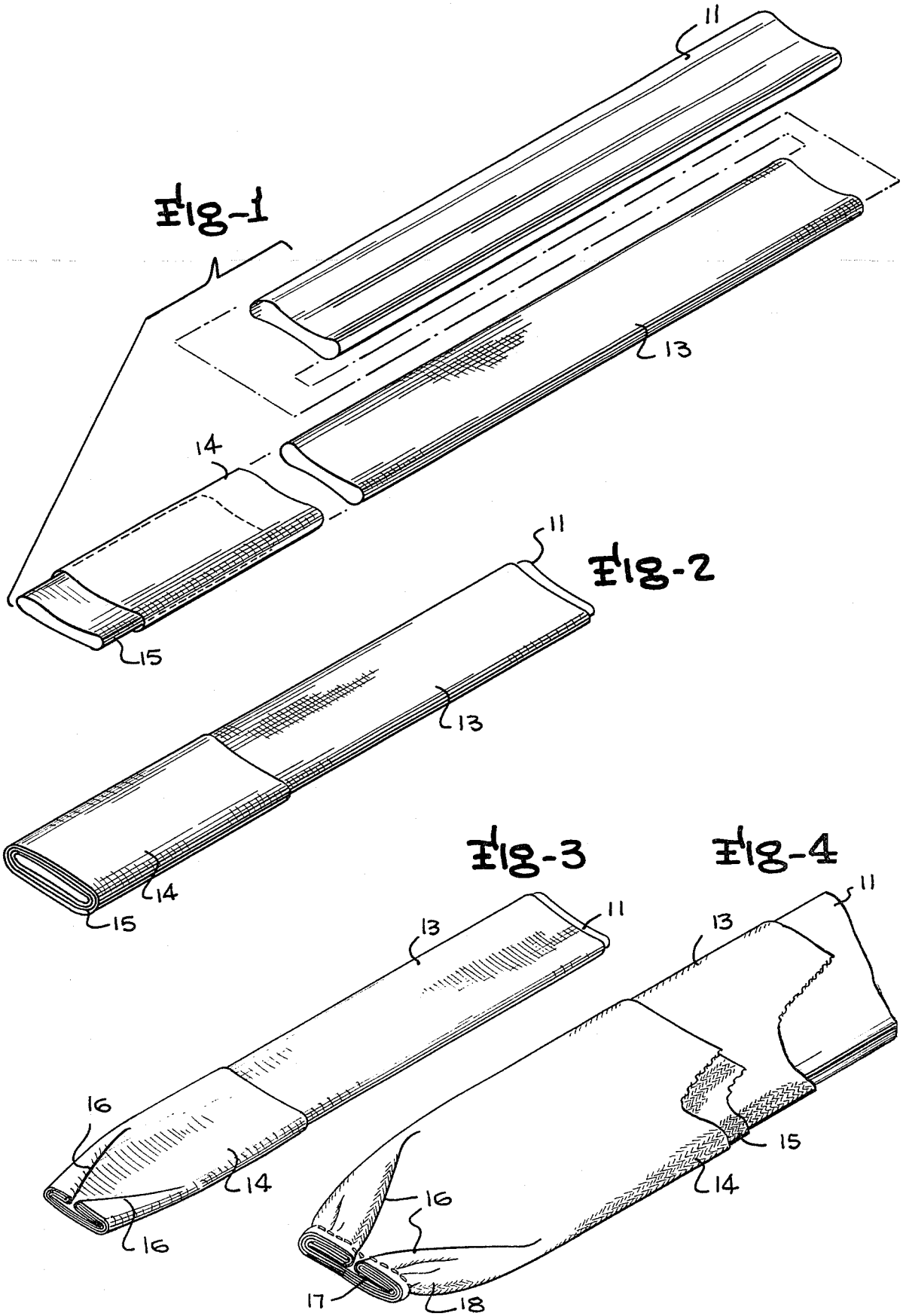
FIG. 1 is a perspective view showing the parts separated for clarity of illustration.
FIG. 2 is a perspective view showing the liner and outer member and sleeve portions.
FIG. 3 is a perspective view showing the bottom end folded over.
FIG. 4 is a fragmentary perspective view showing the bottom end secured to form a closed lower end as by means of stitching, and with parts broken away and in section.
Figure 5:
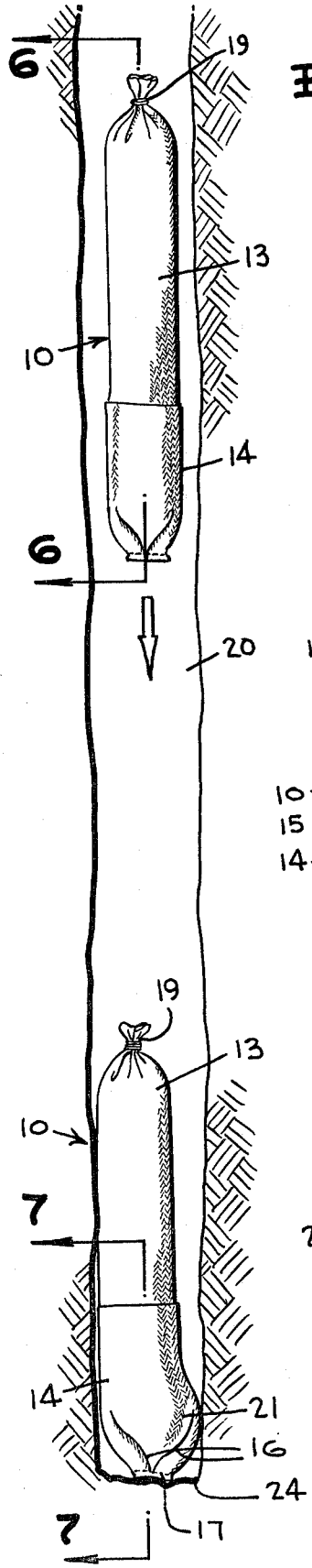
FIG. 5 is a diagrammatic view illustrating the explosive bags being dropped down a hole.

As shown in FIG. 3, after the inner liner 11 has been inserted in the outer woven support member 13, the lower portion of the bag is folded over as at 16, and subsequently as shown in FIG. 4, the lower end is closed as at 17 and this closed lower end may be formed by stitching as at 18 to provide a lower closed end. As shown in FIGS. 5 and 6, after the bag has been filled with the desired quantity of explosive material, tie members 9 may be used for securing in a closed position the upper end of the bag.

Figure 7:
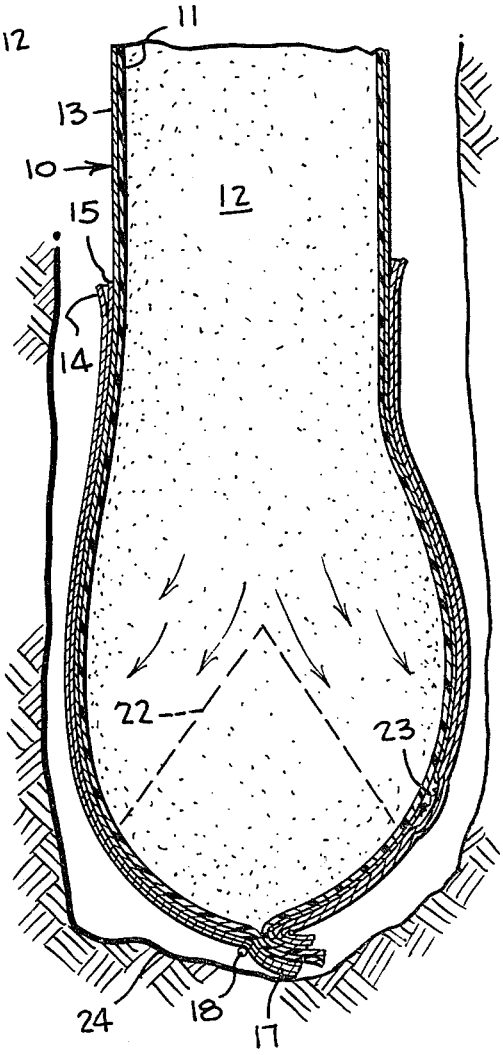
FIG. 7 is an enlarged fragmentary sectional view taken on the Line 7—7 of FIG. 5.

In FIG. 5 the numeral 20 indicates a hole in which one or more of the explosive bags 10 may be dropped, and in FIG. 5 the numeral 21 illustrates the bulging lower portion of the bag that occurs when the bag hits the bottom 24 of the well or hole or water-line. FIG. 6 shows a cone shaped effect 22 that illustrates the position that the explosive granular material assumes in the bag. In FIG. 7 the numeral 23 indicates the break that can occur in the bag for explosives.

From the foregoing, it will be seen that there has been provided bags for explosives, and in use with the parts arranged as shown in the drawings, the outer woven support member 13 has the inner liner 11 arranged therein, and a suitable quantity of granular explosive material 12 is arranged in the bag as shown in FIG. 6. When forming the bag, with the sleeves or girdles 14 and 16 on the lower portion of the bag, initially portions of the bag are folded inwardly or over as at 16, and then the lower end of the bag is sealed, closed, as at 17 by means of stitching 18 and the like. Then, the upper end of the bag is closed by means by ties 19.

When it is desired to detonate the explosive bag(s) for any desired purpose, one or more of the bags 10 filled with explosives can be dropped down a hole or well as indicated by the numeral 20 in FIG. 5, and suitable detonators, fuses and the like can be used for selectively setting off the explosive when desired or required. When the bag 10 strikes the bottom 24 of the hole, a cone effect 22 occurs in the granular material as shown in FIGS. 6 and 7, and in addition one or more breaks 23 may occur as shown in FIG. 7.

The parts can be made of any suitable material and in different shapes or sizes as desired or required.

The present invention is specially suitable as a method and means for improving the existing state of the art in wethole explosive containers. The explosive bag consists of the layer or tubing of plastic such as polyethylene 11 on the inside, and a woven member or layer of material such as plastic polypropylene on the outside, and the construction of the bag is such that the internal dynamics with the granular explosive material produces the highly sophisticated and efficient action including the bulging boot portion 21, break 23, cone-shaped formation 22 and the like. It was discovered that when the bag is dropped down a hole, a forward motion is developed and the bag bursts on the lower one-third portion directly in proportion to the amount of energy generated in the fall or drop. Thus, in order to make the most economical container, the lower one-third of the bag has been reinforced by bands or sleeves 14 and 15 that are attached to the bottom of the bag and they extend approximately one-third the distance up the bag, and this construction provides a bag that can withstand environmental dropping into deep holes such as 200 foot holes either in water, on to tailings and the like. Further, it was determined that further economics could be achieved if the container burst at random in the bottom filament of the bag instead of using a seam that other types of bags use.

With the present invention, the bag swells out at 21 and breaks at random as at 23. The bag is water-proof. By eliminating glued or sewn longitudinal seams, problems are overcome in such seams since heretofore the seams have not held up during use. The explosive bag of the present invention can be used for any desired purpose such as in strip mining of coal, quarry operations and the like.

It will be seen that with the bag of the present invention there is provided reinforcements at the lower portion by means of the girdles or sleeves 14 and 15 so that the bag will not burst until the proper moment. One or two or more sleeves can be provided on the lower portion of the bag. The bags can be used in shallow holes as well as in deep holes.

The explosive bags in the present invention are especially suitable for holding explosives that fragment seams of coal or overburden so that excavation by mechanical means is facilitated. The explosive material 12 can be of any suitable type such as ammonium nitrate, mixed with diesel fuel like, but not limited to any to any particular explosive material. The bag is constructed so that moisture will be kept out of the explosive material 12 even when the bags are dropped into deep water. Or, water will be kept away from the explosive material even when the bags are dropped into a dry hole that later fills with water due to the water table level so that the hole or surface water floods the hole. The inner and outer materials remain dimensionally stable when striking water and the like so that the bag does not block the hole and/or prematurely break and allow water to enter the contents. The explosive bags of the present invention are safe to use and extremely effective, and wherein failed explosions are minimized or eliminated. The circular woven outer bag 13 is unique to the explosive industry because it has no sewn side seams whereby improper breaks are eliminated which usually occur along glued seams or sewn seams. However, the bag can break at random strands as at 23, FIG. 7 and the construction of the bag is such that a bell-shaped bottom or bulging portion 21 is provided that permits the inner bag to swell or not burst. To eliminate the bell shape, girdles or double layers on the bottom one-third of the bag can be provided so that the bag will stay together during much deeper drops. One layer or girdle will increase the strength of the bag by a very large amount. The cost of the sleeve or girdle is minimal when compared to any other method of achieving the function.

The present invention utilizes certain laws of physics in conjunction with the granular material within the bag. The bottom of the circular bag forms an inert cone 22 whose base is the circumference of the bag, and whose height is determined by the natural angle of inclination of the particular material such as ammonium nitrate with fuel oil. All the granular material above the cone flows down the bag in an attempt to retain the dynamics in motion from the height at which it was released, and anything with less strength will be broken. If the bag is a glued or sewn side seam, the energy generated by the fall or in the drop will rupture the seam. If the bag has a glued or sewn side seam, the energy generated by the drop will break the bag at its weakest point which is the sewn or glued seam. If the bag is made of circular woven material as in the present invention, the bag breaks at random filaments of the yarn forming a bell-bottom bag whose inner liner expands equally and does not burst the inner line. If the side seam which is sewn bursts, the inner liner has to expand only at this joint line, and the inner liner not having enough elasticity at this one point ruptures. Improper rupturing exposes the explosive material to water and makes it unuseable.

Explosive bags may either rupture inadvertently or prematurely, or else they may have sufficient strength to contain the energy generated for example when free-falling down a deep hole. Due to the discovery of the energy dissipation previously noted, the area of the bag at the weakest point is reinforced by adding one or more sleeves or girdles 14 and 15 on the bottom one-third of the bag and the sleeves may either be made of woven material or extruded flat plastic material. When using a circular woven material, no glued or sewn seams need be used. The bag is constructed so that when the bags are dropped down a hole, wear against the sides of the hole are minimized during the dropping of the bags down the hole. Ideally a bag that does not bell out or burst is the most efficient answer for a wet-hole bag that completely sinks to the bottom of the wet hole. Bags that bell out are next in efficiency, and bags that burst along with glued or sewn seams tend to lock sidewise and block further bags from entering the hole so that the bags will become stacked one upon the other in the hole.

The explosive bags of the present invention can be used for holding explosives as, for example, in fragmenting seams of coal on overburden of that excavation by mechanical means is facilitated. The granular material in the bags may be ammonium nitrate, fuel, slurry, or other explosive material. The purpose of the bags is to keep water out of the contents of the bag when dropped down 200 feet or more or less into water or the like. Or the bags may be dropped into the dry hole(s) that will later fill with water because of the water table level filling the hole or surface water flooding the hole. The bag can be made economically and it is safe to use and the bag has unique characteristics including the circular woven outer bag which does not have glued or sewn seams. Further, the construction permits folding over of the lower end as at 16, as well as subsequent sewing, and ears and the like are eliminated. The girdles or sleeves 14 and 15 assure that the bag will remain in its proper shape during use. With the present invention the bag is reinforced at its weakest point or points so that a non-rupturable bag is provided.

Suitable conventional detonators may be used in conjunction with the bag(s). The cone-shaped portion 22, forms or remains at the bottom, and the material shears off the cone and bursts the bag in the bottom one-third thereof. The bag may be of the type that breaks open on the bottom, or it may be a bag that breaks at random on the filaments on the bottom circumference shaping out to a bell. This is in contrast to other bags which break at the seam as when such seams are glued or sewn.

While several embodiments of the present invention have been illustrated herein in particular detail, it will be understood that variations and modifications may be effected without departing from the spirit and scope of the novel concepts of this invention.

I claim:

1. A bag for explosives, said bag comprising: an inner tubular plastic liner adapted to receive a quantity of granular explosive material therein, an outer woven plastic body member having said tubular liner therein, sleeves mounted on the lower portion of the bag and surrounding approximately the lowermost one-third portion of said body member, the lower end portion of the bag being folded inwardly and over upon itself, the lower end of the bag being secured closed to form a closed bottom end, and a tie member for closing the upper end of the bag, said bag being free of longitudinal seams.

2. The structure as defined in claim 1, wherein the sleeves are made of woven material and are mounted on the lower approximate one-third of the bag.

* * * * *